United States Patent [19]

Parker et al.

[11] 4,016,561

[45] Apr. 5, 1977

[54] PUSH BUTTON SWITCH WITH INDICATOR

[75] Inventors: Ralph L. Parker, Melbourne Beach; Daniel B. Hoskins, Maitland, both of Fla.

[73] Assignee: TRW Inc., Los Angeles, Calif.

[22] Filed: June 28, 1974

[21] Appl. No.: 484,062

[52] U.S. Cl. ..... 340/381; 200/314

[51] Int. Cl.[2] ..... G09F 9/14

[58] Field of Search ..... 340/381, 373, 253; 200/169 R, 160, 314, 310

[56] References Cited

UNITED STATES PATENTS

| | | | |
|---|---|---|---|
| 3,272,951 | 9/1966 | O'Brien | 340/314 |
| 3,274,354 | 9/1966 | Stevens | 200/160 UX |
| 3,560,689 | 2/1971 | Matson | 200/314 X |
| 3,567,888 | 3/1971 | Long | 200/160 |
| 3,598,948 | 8/1971 | Bowen | 200/314 X |

*Primary Examiner*—John W. Caldwell
*Assistant Examiner*—William M. Wannisky
*Attorney, Agent, or Firm*—Duckworth, Hobby, Orman, Allen & Pettis

[57] ABSTRACT

A switch comprises a housing and a shaft movable into and out of the housing with two circuit paths carried by the housing and adapted to be interconnected only during movement of one of the paths across the other path. Means are provided for moving the one path across the other path; in one embodiment, this means comprises a cam and bevel arrangement carried by the shaft.

10 Claims, 6 Drawing Figures

PUSH BUTTON SWITCH WITH INDICATOR

BACKGROUND OF THE INVENTION

1. Field of the Invention

The present invention relates to electrical switches, and in particular, relates to switches of the type employing movement, or "wiping," of one conductor across another conductor to create an electrical transient which performs the switching function.

2. Description of the Prior Art

A large number of cam operated and push button switches are known in the prior art. Examples of such switches are shown in the following U.S. Pat. Nos. 2,802,082 to Kalwo; 3,715,545 to Long; 3,358,111 to Dzierzbicki et al; 3,560,689 to Matson; and 2,903,540 to Gloviak et al, among others.

Many of the switches disclosed in the prior art are designed for specific switching functions, and are not capable of utilization in a large number of switching applications. However, in the data processing field, it is desirable to employ switching components which may be readily adapted to a number of switching operations, for obvious cost and parts reduction reasons.

SUMMARY OF THE INVENTION

The present invention contemplates a switch comprising a housing and a shaft movable into and out of the housing, with two circuit paths carried by the housing and adapted to be interconnected only during movement of one of the paths across the other path. Means are provided for moving the one path across the other circuit path.

In one specific embodiment, the switch is provided with a visual indication means, such as a light emitting diode carried by the shaft, which may be alternately energized or de-energized responsive to movement of the shaft into and out of the housing. Circuit means are provided which process transient signals caused by movement of the one circuit path across the other to alternately energize and de-energize the light emitting device. Alternatively, means are provided for allowing the light to be energized responsive to movement of the shaft into the housing, and thereafter de-energizing the light emitting device responsive only to an external clearing signal.

THE DRAWING

Figure 1:
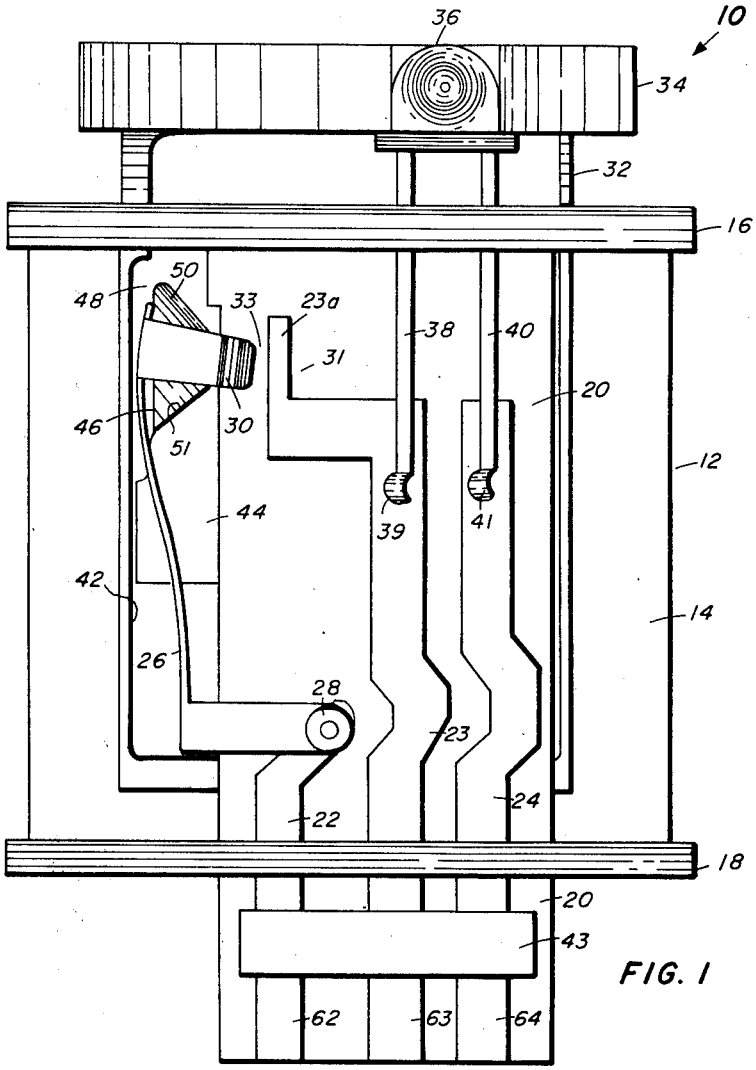
FIG. 1 is a bottom plan view of one embodiment of a switch in accordance with the present invention.
Figure 2:
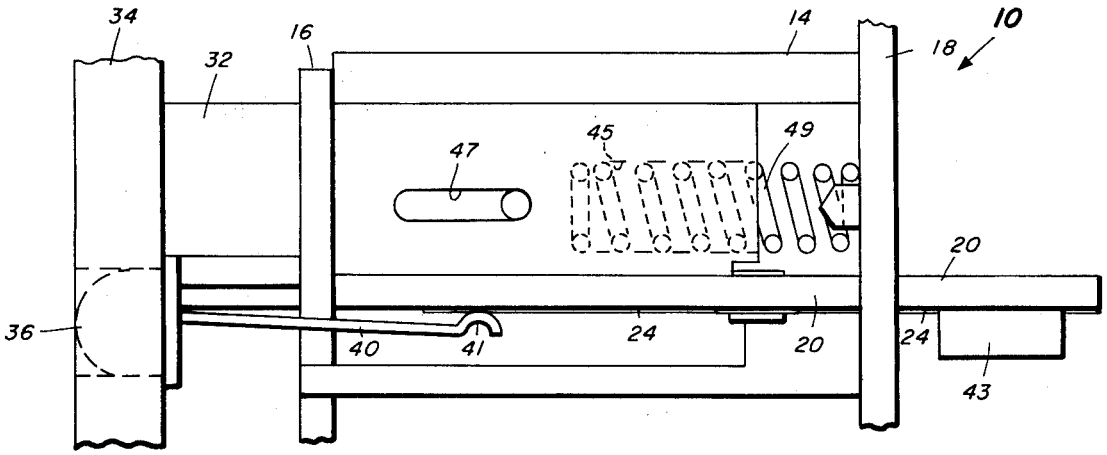
FIG. 2 is a side elevation of the embodiment of FIG. 1.
Figure 3A:
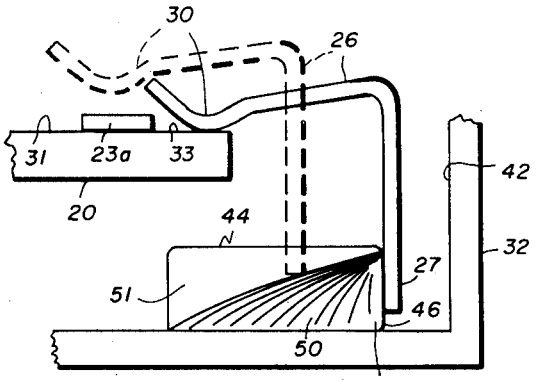
Figure 3B:
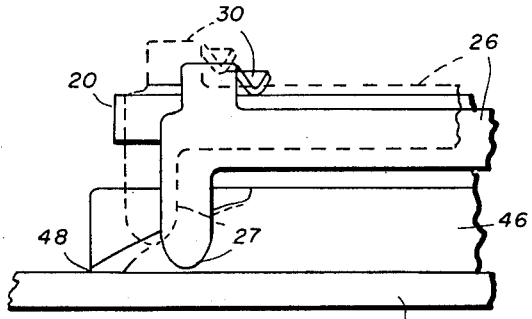

FIGS. 3*a* and 3*b* are front and side elevations of a portion of the embodiment shown in FIGS. 1 and 2.

Figure 4:
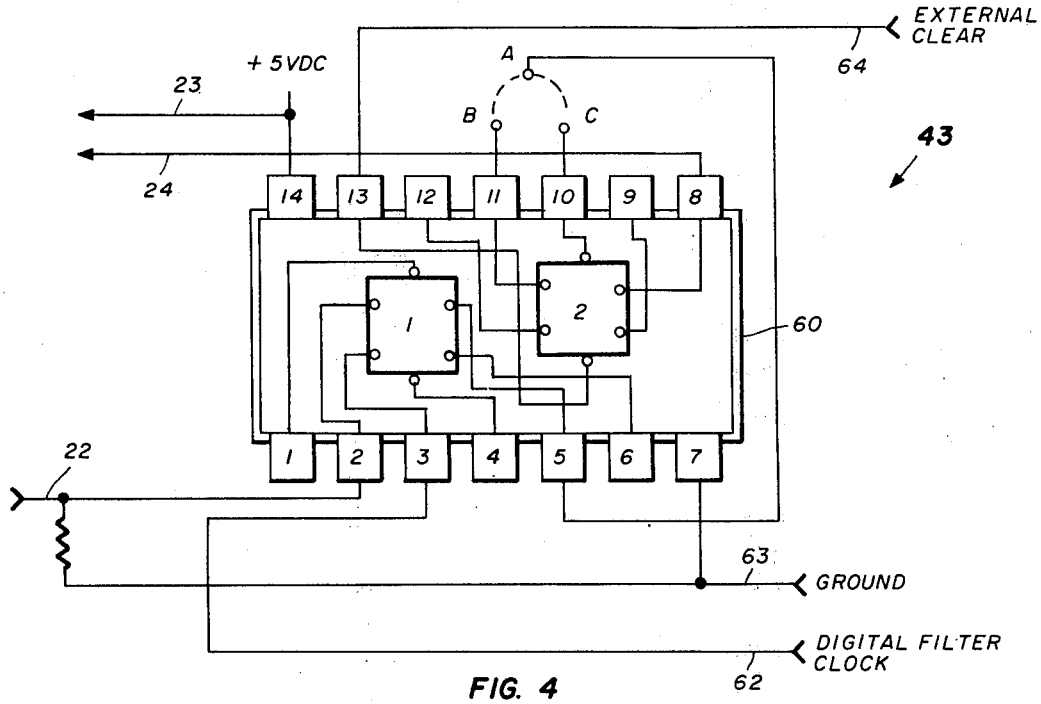

FIG. 4 is a schematic diagram of a portion of the embodiment of FIGS. 1 and 2.

FIGS. 5*a–d* are voltage waveforms representative of the electrical operations of the switch of FIGS. 1 and 2.

DETAILED DESCRIPTION

One embodiment of a switch in accordance with the present invention will now be described.

Referring to FIG. 1, the switch, referred to generally as 10, includes a housing 12 having a floor 14 and two end walls 16 and 18 extending substantially normal to the floor 14. The housing 12 further includes a plate 20 extending between the two walls 16, 18 and through the wall 18.

The plate 20 includes conductive paths 22, 23 and 24 disposed on an exposed surface thereof. The conductive path 23 terminates in an end portion 23*a*. A portion of the conductive path 22 includes a spring clip 26 coupled thereto by a brad 28. The spring clip 26 includes a bent end portion 30, the spring clip 26 being biased such that the end portion 30 is normally positioned to one side 31 of the end portion 23*a*. The side of the plate 20 opposing side 31 across end portion 23*a* is identified by element 33 in FIG. 1.

The switch 10 further includes a shaft 32 movable into and out of the housing 12 through the end wall 16. In this context, the term "shaft" is used in a broad context, since it will be seen from a comparison of FIGS. 1 and 2 that the shaft 32 therein illustrated is a hollow rectanguloid having an open side communicating with the plate 20. An exterior end plate 34 is carried by the shaft 32. In turn, an illuminating device 36, e.g. a light emitting diode (LED), is carried by the end plate 34. The LED 36 includes two flexible terminals 38 and 40, each of which extends through the wall 16 of the housing 12. The extremity of each terminal 38 and 40 has a round contact 39 and 41 respectively, which makes corresponding contact with conductive paths 23 and 24.

Noting the left hand portion of FIG. 1, the shaft 32 has a hollow exterior 42 in which is disposed a cam, referred to generally as 44. The cam 44 includes a straight surface 46 extending substantially parallel with the shaft 32. The details of the cam 44 are more clearly shown in FIGS. 3*a* and *b*, to which reference is now made. The cam 44 further includes a beveled surface 50 beginning at the tip and beveled in a direction toward the plate 20 away from the tip. The beveled surface 50 terminates at an end wall 51. With specific reference to FIG. 3*b*, the spring clip 26 includes a cleat 27 which extends away from the main portion of the spring clip 26 and engages the straight surface 46.

Reference is again made to FIGS. 1 and 2. The three conductive paths 22, 23 and 24 extend through the end wall 18 and terminate in a circuit device 43, which is described in more detail with reference to FIG. 4. Noting FIG. 2, the shaft 32 further includes a bore 45 into which a spring 49 is inserted and biased against the end wall 18, to provide a spring return of the shaft 32. A slot 47 and stop 53 provide means for limiting the throw of the shaft 32. The circuit device 43 will now be described with reference to FIG. 4. The circuit 43 includes an integrated circuit device 60 comprising any one of well known bistable multi-vibrators 60, for example, a Texas Inst. SN7474N. The bistable multivibrator 60, commonly referred to as a "flip-flop" circuit, is wired in the manner shown in FIG. 4. To this end, terminal 2 of the device 60 is coupled to the conductive path 22, and conductive path 23 is coupled with terminal 14. Conductive path 24 is coupled to terminals 8 and 12 of the device 60. The circuit 43 includes a jumper arrangement, as noted between terminal ends A, B and C. These circuit options will be described below in greater detail with respect to the operation of the switch 10. The circuit 43 is also provided with three connections external to the switch 10. The connections provide digital filter clock, ground and external clear, and are made via additional conductive paths 62, 63 and 64, respectively, at the external edge of the plate 20, as is shown in FIG. 1.

Operation of the switch 10 will now be described. Initially, the shaft is biased by the spring 49 in an outermost position, and the LED 36 is not energized. It is assumed for purposes of this description that the switch is disposed in an appropriate circuit arrangement to provide the three external connections 62, 63 and 64 described above. Operation of the switch is initiated by depressing the end plate 34, causing movement of the shaft into the housing 12. During initial movement of the shaft 32 into the housing 12, the cleat 27 of the spring clip 26 bears against surface 46, keeping the bent end portion 30 of the spring clip 26 biased to the side 33 of the conductive path end portion 23*a*.

When the end plate 34 has been depressed sufficiently to cause enough movement of the shaft 32 and the housing 12 to effect movement of the cleat 27 around the tip 48, the spring clip 26 snaps the bend end 30 across the conductive path end portion 23*a*, the bent end 30 subsequently coming to rest at the side 31 out of contact with the conductive path end portion. Assuming energization of the conductive paths 22 and 23, a transient voltage will be generated during movement of the bent end 30 across the conductive path end portion 23*a*. This transient is detected by the circuit 43, which in turn utilizes these transients to energize the LED 36 via conductive paths 23 and 24.

At this point, the operator may then release the end plate 34, causing the spring 49 to bias the shaft outwardly from the housing 12. As the shaft 32 moves out of the housing 12, the cleat 27 is beveled upward across the beveled surface 50 and against the end surface 51. This beveling movement is an upward direction, causing the bent end 30 to be rotated out of contact with the conductive path end portion 23*a* (note the relief representation of the spring clip 26 and bent end 30 in FIG. 3*a*). In this way, the inadvertent generation of additional transients is avoided, therefore allowing the LED 36 to be maintained in an on condition. When the cleat 27 reaches the intersection of the bevel surface 50, the end wall 51 and the side surface 46, the cleat falls down alongside the surface 46 and thereafter maintains the bent end 30 out of contact at the side 33 of the conductive path end portion 23*a*.

Figure 5:
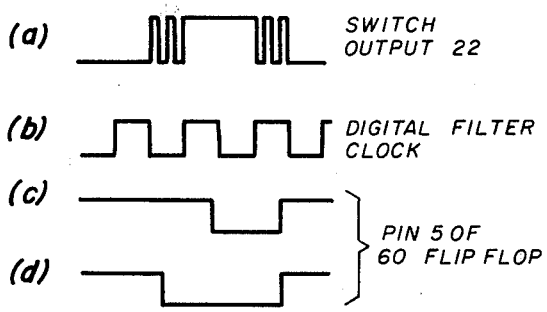

Reference is now made to FIGS. 4 and 5. Assuming a jumper connection is made between A and C of circuit 43, the first transient input (note waveform at FIG. 5*a*) from the switch 10 will set the flip-flop 60 causing the LED 36 to be energized. Thereafter, the LED 36 can only be extinguished with an external clearing signal along the conductive path 64.

However, if the jumper connection is made between A and B, then once the LED 36 is energized, it can be extinguished by either an external clearing signal along conductor path 64 or a transient input from the switch 10 responsive to movement of the shaft into the housing. Waveforms representative of the respective option voltages at pin 5 of the flip-flop 60 are shown at FIGS. 5*c* and 5*d*, respectively.

The above described switch provides means for energizing the light emitting device responsive to a first motion of the switch shaft into the switch housing, and thereafter allows the light emitting device to be optionally de-energized responsive to another movement of the switch shaft into the housing, or to an external clearing signal. It will be appreciated that this arrangement provides a low cost device which is useful in many applications.

We claim:

1. A switch comprising:

a housing;

a shaft movable into and out of said housing;

two conductive paths carried by said housing, one of said conductive paths comprising a spring clip having an end portion biased normally to one side of, and out of contact with the other of said conductive paths;

means for moving one of said conductive paths across the other of said conductive paths responsive to movement of said shaft;

an electrical circuit element energized responsive only to interconnection of said two conductive paths;

means for maintaining said circuit element energized for a period of time independent of said movement of said shaft;

means for preventing movement of said one conductive path across the other of said conductive paths during movement of said shaft out of said housing, this means comprising a cam carried by said shaft, said cam including;

a straight shoulder substantially parallel with said shaft for holding said spring clip away from said other conductive path such that said end portion thereof is held on a side of said other conductive path opposite said one side during engagement with said shoulder;

said conductive path interconnecting means including a tip along said shoulder for releasing said clip whereby said end portion moves along said other conductive path to said one side thereof;

a beveled surface for camming said end portion out of contact with said other conductive path during movement of said shaft out of said housing; and wherein said spring clip includes means for engaging said cam during movement of said shaft into and out of said housing.

2. The switch recited in claim 1 further comprising:

said circuit element comprising visual indicating means carried by said shaft exteriorly from said housing; and means for electrically connecting said visual indicating means to at least one of said conductive paths.

3. The switch recited in claim 2 further comprising means for de-energizing said visual indicating means responsive to another movement of said one conductive path across said other of said two conductive paths.

4. The switch recited in claim 3 further comprising:

a third conductive path carried by said housing; and means for electrically coupling said visual indicating means to said third conductive path.

5. The switch recited in claim 4 wherein said circuit element is interposed in said three conductive paths.

6. The switch recited in claim 5 wherein said circuit element further comprises means for receiving an output from said switch responsive to said interconnection of said two conductive paths and for energizing said visual indicating means responsive thereto.

7. The switch recited in claim 6 wherein said output receiving means comprises a bistable multi-vibrator.

8. The switch recited in claim 7 further comprising means for de-energizing said visual indicating means responsive to one of a clearing signal to said switch or further interconnection of said two conductive paths.

9. The switch recited in claim 1 further comprising circuit means interposed in said two circuit paths for receiving a signal responsive to interconnection of said two conductive paths and providing an output responsive thereto.

10. The switch recited in claim 9 further comprising visual indicating means carried by said switch, said visual indicating means responsive to said output from said circuit means.

* * * * *